US008342507B2

(12) United States Patent
Takahashi et al.

(10) Patent No.: US 8,342,507 B2
(45) Date of Patent: Jan. 1, 2013

(54) SHEET CONVEYING DEVICE AND IMAGE FORMING APPARATUS

(75) Inventors: Toshiaki Takahashi, Tokyo (JP); Yoshikuni Ishikawa, Tokyo (JP); Manabu Nonaka, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 62 days.

(21) Appl. No.: 12/929,833

(22) Filed: Feb. 18, 2011

(65) Prior Publication Data

US 2011/0204558 A1 Aug. 25, 2011

(30) Foreign Application Priority Data

Feb. 22, 2010 (JP) ..... 2010-036697

(51) Int. Cl.
*B65H 3/16* (2006.01)

(52) U.S. Cl. ..... 271/18.1

(58) Field of Classification Search ..... 271/18.1, 271/18.2, 193, 34, 114, 117, 118, 208, 901
See application file for complete search history.

(56) References Cited

U.S. PATENT DOCUMENTS 4,431,175 A * 2/1984 Smith ..... 271/10.08

FOREIGN PATENT DOCUMENTS

| | | | |
|---|---|---|---|
| JP | 04251041 A | | 9/1992 |
| JP | 05-139548 A | | 6/1993 |
| JP | 09-194060 A | | 7/1997 |
| JP | 09-278206 A | | 10/1997 |
| JP | 2000-186550 | * | 7/2000 |
| JP | 2003-160242 | * | 6/2003 |
| JP | 2003237962 A | | 8/2003 |
| JP | 2003237969 A | | 8/2003 |
| JP | 2010-105807 A | | 5/2010 |
| WO | WO2010/061895 | * | 6/2010 |

* cited by examiner

*Primary Examiner* — Gerald McClain
*Assistant Examiner* — Thomas Morrison
(74) *Attorney, Agent, or Firm* — Harness, Dickey & Pierce, P.L.C.

(57) ABSTRACT

A sheet conveying device includes an attraction belt, multiple rollers, a charging device, and a contacting and separating device. The attraction belt is arranged to face the upper surface of a stacked sheet stack. The multiple rollers stretch the attraction belt with tension. The charging device charges a surface of the attraction belt. The contacting and separating device causes the attraction belt to come into contact with and separate from the sheet stack, with different tensions set for the attraction belt at a contact position in contact with the uppermost sheet of the sheet stack and the attraction belt at a separation position separate from the sheet stack.

4 Claims, 3 Drawing Sheets

SHEET CONVEYING DEVICE AND IMAGE FORMING APPARATUS

CROSS-REFERENCE TO RELATED APPLICATIONS

The present invention claims priority pursuant to 35 U.S.C. §119 from Japanese Patent Application No. 2010-036697, filed on Feb. 22, 2010 in the Japan Patent Office, which is hereby incorporated by reference herein in its entirety.

BACKGROUND OF THE INVENTION

1. Field of the Invention

The present invention relates to a sheet conveying device and an image forming apparatus.

2. Description of the Related Art

As a method of separating and conveying stacked sheets, such as documents and recording sheets, a separating and conveying method using frictional force and a separating and conveying method based on air suction have been used. The separating and conveying method using frictional force typically uses, for example, a rubber feeding roller, and as a result the frictional force changes over time due to abrasion and other factors, such that feeding performance deteriorates. Further, when sheets non-uniform (i.e., varying) coefficient of friction or sheets having different coefficients of friction are separated and conveyed in the same separating and conveying operation, a feeding failure occurs in some cases, which includes simultaneous multiple feeding of a plurality of sheets and a failure to separate sheets. Further, in some cases, the sheets are stained due to a configuration that separates the sheets by applying pressure thereto in the sheet feeding operation.

Meanwhile, the separating and conveying method using air suction is a non-frictional separation method not relying on the coefficient of friction of rollers and sheets. The method, however, uses an air suction blower and an air duct. Thus, the sheet conveying device is increased in size, and air suction sound itself is noise. Therefore, the device is not suitable for use in an office environment.

In view of the above, an electrostatic method as one type of non-frictional separation method has been proposed, which generates an electric field in a dielectric belt and brings the dielectric belt into contact with a sheet to simultaneously attract the sheet and separate the sheet from other sheets. According to the electrostatic method, an attraction belt that serves as a dielectric belt wound around a plurality of rollers is supplied with an alternating charge, and is brought into contact with a surface of the uppermost sheet of a sheet stack to attract the uppermost sheet of the sheet stack. The attraction belt having attracted the uppermost sheet is then moved in a direction separating the uppermost sheet from the sheet stack, thus separating the uppermost sheet of the sheet stack from the sheet stack. Then, the attraction belt is driven to rotate and convey the uppermost sheet attracted thereto to a conveying roller pair. The electrostatic method as described above is advantageous in preventing, for example, abrasion, damage to a sheet, and noise, and reducing the size of the device.

If the uppermost sheet of the sheet stack includes an undulating or curled portion, however, such a portion sometimes results in an insufficient area of contact between the uppermost sheet of the sheet stack and the attraction belt and therefore insufficient electrostatic. attraction of the uppermost sheet to the attraction belt. If the attraction belt is moved in the direction separating the uppermost sheet from the sheet stack in this state of insufficient electrostatic attraction, the uppermost sheet is separated from the attraction belt instead and can cause conveyance failure.

The present inventors studied the insufficient electrostatic attraction of the uppermost sheet of the sheet stack to the attraction belt caused by an undulating or curled portion of the sheet, and found the following. That is, when the attraction belt is driven to rotate in a typical configuration, the attraction belt is stretched by a plurality of tension rollers with relatively high tension to favorably drive the attraction belt to rotate without causing slippage between the attraction belt and one of the tension rollers that serve as a drive roller. If the tightly stretched attraction belt is brought into contact with the uppermost sheet of the sheet stack, therefore, the attraction belt fails to fit the shape of the undulating or curled portion of the uppermost sheet, and consequently results in an insufficient area of contact between the uppermost sheet and the attraction belt.

SUMMARY OF THE INVENTION

The present invention describes a novel sheet conveying device. In one embodiment, a sheet conveying device includes an attraction belt, multiple rollers, a charging device, and a contacting and separating device. The attraction belt is arranged to face the upper surface of a sheet stack. The multiple rollers around which the attraction belt is would keep the attraction belt taut. The charging device charges a surface of the attraction belt and is located in proximity to the attraction belt. The contacting and separating device contact the attraction belt with and then separate from the sheet stack, with different tensions on the attraction belt at a contact position in contact with the uppermost sheet of the sheet stack and at a separation position separate from the sheet stack.

The tension of the attraction belt at the contact position in contact with the uppermost sheet of the sheet stack may be lower than the tension of the attraction belt at the separation position separate from the sheet stack.

The multiple rollers may include two rollers including an upstream roller and a downstream roller in the sheet conveying direction. The contacting and separating device may include a side plate swingably supported around a fulcrum positioned upstream of the upstream roller in the sheet conveying direction, the side plate to rotatably support the two rollers and to support the upstream roller to be movable in upward and downward directions within a predetermined range with respect to the upper surface of the sheet stack.

The side plate may include a slot to rotatably support the upstream roller, and is shaped so that an inter-axial distance between the two rollers at the contact position to be less than the inter-axial distance between the two rollers at the separation position.

The above-described sheet conveying device may further include a slotted member rotatably attached to the side plate. The slot may be provided in the slotted member.

The present invention further describes an image forming apparatus. In one example, an image forming apparatus includes an image forming device to form an image on a sheet and the above-described sheet conveying device to separate the uppermost sheet from a stacked sheet stack and convey the uppermost sheet to the image forming device.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
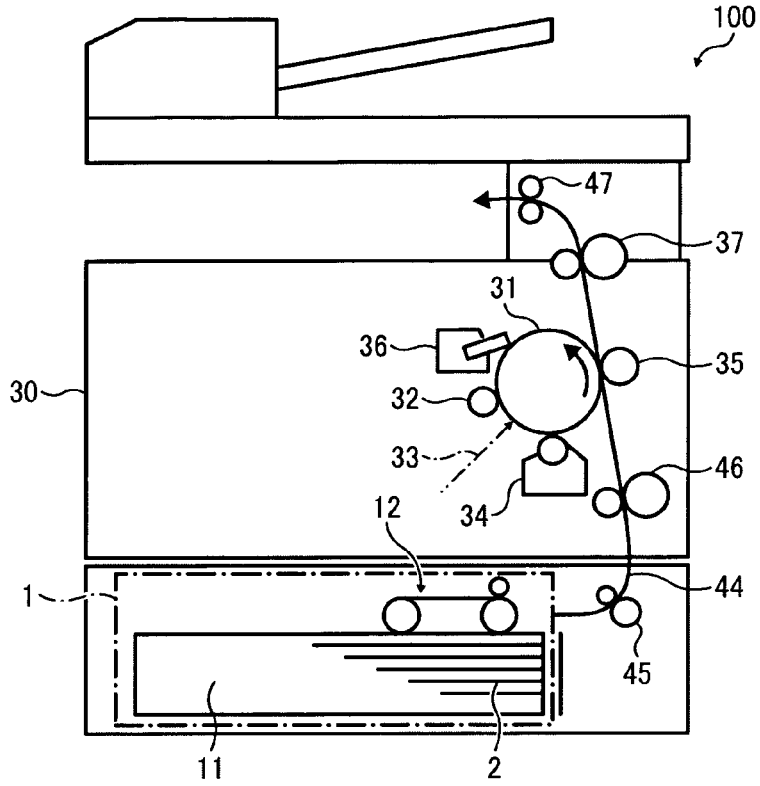
FIG. 1 is a schematic configuration diagram of a copier as an image forming apparatus according to an embodiment of the present invention.

In describing the embodiments illustrated in the drawings, specific terminology is employed for purposes of clarity. However, the disclosure of this patent specification is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, a description will be given of an electrophotographic copier as an image forming apparatus according to an embodiment of the present invention. An overall configuration and operation of the copier will be first described.

FIG. 1 is a schematic configuration diagram of a copier 100 according to the present embodiment. The copier 100 includes an image forming unit 30 that serves as an image forming device. The image forming unit 30 includes a photoconductor 31 that serves as a latent image carrying member, and also includes, for example, a charging device 32, a development device 34, a transfer device 35, and a photoconductor cleaning device 36 surrounding the photoconductor 31. The image forming unit 30 further includes, for example, a not-illustrated optical writing unit for directing laser light 33 onto the photoconductor 31 and a fixing device 37 for fixing a toner image formed on a sheet (i.e., recording medium). Below the image forming unit 30, a sheet conveying device 1 is provided that includes a sheet storage unit 11 and an attractive separation unit 12 and stores a sheet stack 2 including multiple sheets, to which images formed of the image forming unit 30 are to be transferred. The sheet conveying device 1 sequentially conveys the sheets to be supplied to the image forming unit 30. The copier also includes a sheet conveying path 44, a conveying roller pair 45, and a registration roller pair 46.

In the image forming unit 30 having the above-described configuration, the charging device 32 first uniformly charges a surface of the photoconductor 31 in accordance with the rotation of the photoconductor 31. Then, on the basis of image data, the optical writing unit applies the laser light 33 to the surface of the photoconductor 31 to form thereon an electrostatic latent image. Thereafter, the development device 34 adheres toner to the surface of the photoconductor 31 to visualize the electrostatic latent image. Thereby, a toner image is formed on the surface of the photoconductor 31. Meanwhile, the sheet conveying device 1 conveys each of the sheets by separating one sheet from the other sheets. The sheet thus separated is then fed into the sheet conveying path 44, conveyed by the conveying roller pair 45 on the sheet conveying path 44, and abuts and is stopped by the registration roller pair 46. The sheet thus abutting and stopped by the registration roller pair 46 is then sent, in precise timing with the formation of the toner image by the image forming unit 30, to a transfer unit in which the transfer device 35 faces the photoconductor 31. In the transfer unit, the toner image on the photoconductor 31 is transferred onto the supplied sheet. The sheet having the toner image transferred thereto is then subjected to a fixing process by the fixing device 37 to fix the toner image thereon, and thereafter is discharged outside the copier, i.e., the image forming apparatus. Meanwhile, the surface of the photoconductor 31 after the transfer of the toner image is cleaned by the photoconductor cleaning device 36 to remove residual toner therefrom, thereby preparing the photoconductor 31 for the next image forming operation.

Figure 2:
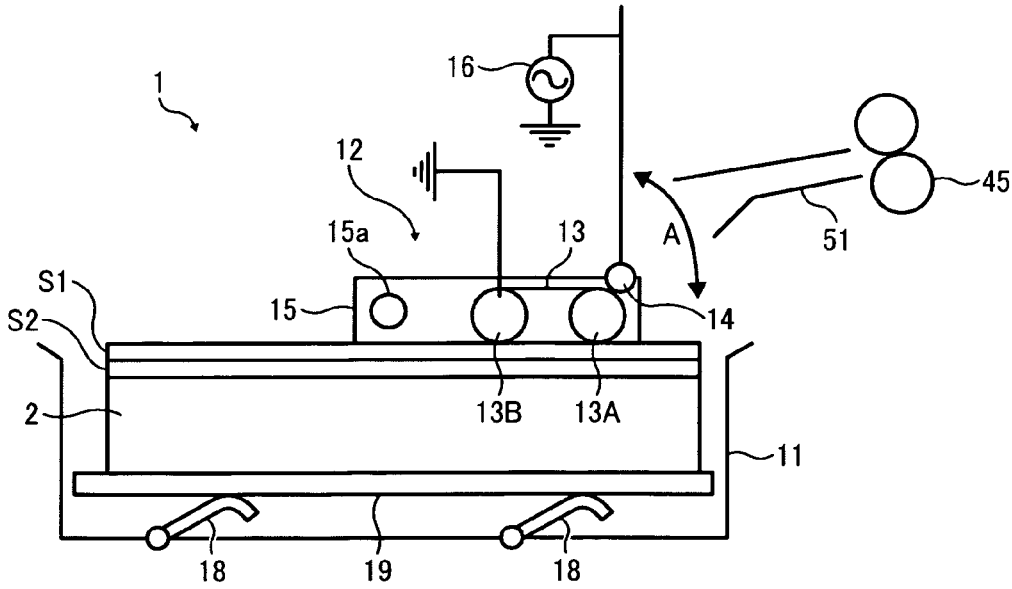
FIG. 2 is a schematic configuration diagram of a sheet conveying device of the copier.

Subsequently, a description will be given of the sheet conveying device 1, which is characteristic of the copier 100 according to the present embodiment. FIG. 2 is a side view illustrating a schematic configuration of the sheet conveying device 1. As illustrated in FIG. 2, in the sheet conveying device 1, the sheet storage unit 11 includes support members 18 and a bottom plate 19, and the attractive separation unit 12 located above the sheet storage unit 11 includes an attraction belt 13, a drive roller 13A, a driven roller 13B, and a charging roller 14. FIG. 2 also illustrates a side plate 15, a rotary shaft 15*a*, an alternating-current power supply 16, the conveying roller pair 45, a guide member 51, and the sheet stack 2 including the uppermost sheet S1 and the second sheet S2.

In the sheet storage unit 11, the bottom plate 19 carries thereon the sheet stack 2 of a plurality of stacked sheets. Further, the support members 18 are rotatably attached to a bottom portion of the sheet storage unit 11 to support the bottom plate 19.

The bottom plate 19 is moved as follows. The sheet storage unit 11 includes a not-illustrated sheet detection device that detects the arrival of the uppermost sheet S1 of the sheet stack 2 at a predetermined position. The support members 18 are rotated in the counterclockwise direction in the drawing by a not-illustrated drive motor to lift the bottom plate 19. Thereby, the sheet stack 2 stacked on the bottom plate 19 is lifted, and the sheet detection device detects the uppermost sheet S1. Upon detection by the sheet detection device of the arrival of the uppermost sheet S1 of the sheet stack 2 at the predetermined position, the rotation of the support members 18 is stopped.

In the attractive separation unit 12, the attraction belt 13 is stretched taut by two tension rollers, i.e., the drive roller 13A and the driven roller 13B. The driven roller 13B is biased in the left direction in the drawing by a not-illustrated spring to apply tension to the attraction belt 13. The attraction belt 13 is formed of a dielectric material having an electrical resistance of at least approximately $10^8$ Ωcm (ohm centimeters). For example, the attraction belt 13 may be formed of a film made of polyethylene terephthalate or the like having a thickness of approximately 100 μm. Further, the drive roller 13A has a surface formed of a conductive rubber layer having a resistance value of approximately $10^6$ Ωcm, and the driven roller 13B is a metal roller. The drive roller 13A and the driven roller 13B are both grounded. The drive roller 13A has a relatively small diameter, suitable for separating a sheet from the attraction belt 13 in accordance with the curvature thereof. Further, the drive roller 13A is configured to be intermittently driven by a not-illustrated drive motor via an electromagnetic clutch in accordance with a sheet feeding signal. The drive roller 13A and the driven roller 13B are rotatably supported by the side plate 15 of the attractive separation unit 12. The side plate 15 is fixed to the rotary shaft 15*a*, and the attractive separation unit 12 is supported by the body of the sheet conveying device 1 to be swingable in the directions indicated by a double-headed arrow A in the drawing.

Further, in the attractive separation unit 12, the charging roller 14 that serves as a charging device comes into contact with a portion of the attraction belt 13 wound around the drive roller 13A. The charging roller 14 is connected to the alternating-current power supply 16, and charges the attraction belt 13 by applying an alternating charge to the outer circumferential surface thereof. The charging roller 14 is rotatably supported by the attractive separation unit 12, and the position of the charging roller 14 with respect to the attraction belt 13 is uniquely determined. Further, the inner surfaces of the opposed edges of the attraction belt 13 are provided with meandering prevention ribs that engage the opposed end surfaces of the drive roller 13A and the driven roller 13B that serve as the tension rollers to prevent the attraction belt 13 from meandering.

Figure 3A:
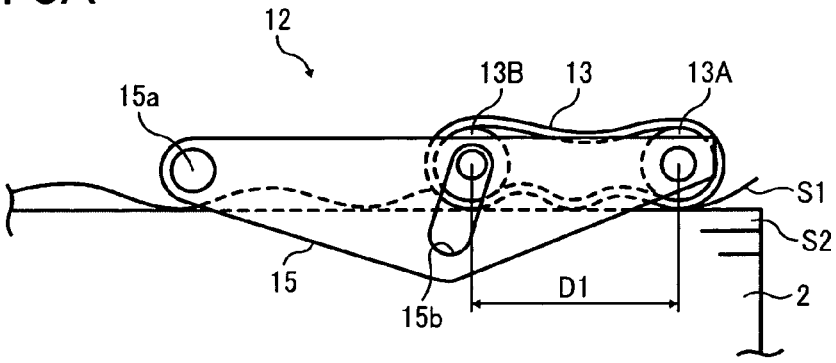
FIGS. 3A and 3B are configuration diagrams of relevant components of an adsorptive separation unit of the sheet conveying device.
Figure 3B:
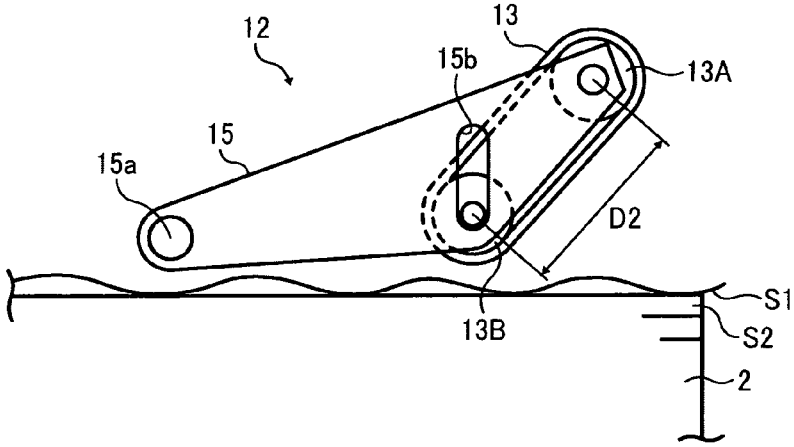

FIGS. 3A and 3B are schematic diagrams of relevant components of the attractive separation unit 12. As illustrated in the drawings, the driven roller 13B, which is the upstream tension roller in the sheet conveying direction, is rotatably supported along a slot 15*b* provided in the side plate 15 that serves as a swing member. Meanwhile, the drive roller 13A is rotatably supported yet immovable with respect to the side plate 15. The slot 15*b* is configured such that the inter-axial distance between the driven roller 13B and the drive roller 13A changes in accordance with the movement of the driven roller 13B in the slot 15*b*. Specifically, an inter-axial distance D1 at a contact position of the attraction belt 13 in contact with the upper surface of the sheet stack 2, as illustrated in FIG. 3A, is less than an inter-axial distance D2 at a separation position of the attraction belt 13 separate from the upper surface of the sheet stack 2, as illustrated in FIG. 3B. As a result, the attraction belt 13 at the contact position is reduced in tension. If the uppermost sheet S1 includes an undulating portion or the like, therefore, the attraction belt 13 deforms to fit the shape of the undulating portion of the uppermost sheet S1, as illustrated in FIG. 3A. Accordingly, even if the uppermost sheet S1 includes an undulating portion, a sufficient area of contact is obtained between the attraction belt 13 and the uppermost sheet S1, and thus favorable electrostatic attraction property is obtained.

Meanwhile, the attraction belt 13 at the separation position is stretched with predetermined tension by the drive roller 13A and the driven roller 13B. Therefore, the attraction belt 13 is favorably driven to rotate, and a conveyance failure is prevented.

The side plate 15 is supported by the body of the sheet conveying device 1 to be swingable around a fulcrum set to a position upstream in the sheet conveying direction of the driven roller 13B, which is the upstream tension roller in the sheet conveying direction. Specifically, the side plate 15 is fixed to the rotary shaft 15*a* provided upstream of the driven roller 13B in the sheet conveying direction. Further, the rotary shaft 15*a* is connected to a not-illustrated drive device, such as a stepping motor, capable of adjusting the angle of rotation. If the rotary shaft 15*a* is rotated in the counterclockwise direction by a predetermined angle by the drive device, the side plate 15 is rotated in the counterclockwise direction by the predetermined angle. Thereby, the attraction belt 13, in contact with the uppermost sheet S1 of the sheet stack 2, as illustrated in FIG. 3A, moves to a position at which the attraction belt 13 is separate from the sheet stack 2, as illustrated in FIG. 3B. That is, in the present embodiment, the side plate 15, the rotary shaft 15*a*, and the drive device form a contacting and separating device.

A description will be given of operations of the sheet conveying device 1 using the above-described attractive separation unit 12.

First, a charging operation will be described. The attractive separation unit 12 normally stands by at the position illustrated in FIG. 3B. Upon receipt of a sheet feeding signal, the electromagnetic clutch is turned on. Thereby, the drive roller 13A is driven to rotate, and circularly moves the attraction belt 13. In this state, the driven roller 13B is in contact with the lower end of the slot 15*b*, and the inter-axial distance between the driven roller 13B and the drive roller 13A corresponds to the inter-axial distance D2. Thus, the attraction belt 13 is stretched with relatively high tension by the driven roller 13B and the drive roller 13A. Therefore, the attraction belt 13 is driven to rotate with no slippage occurring between the attraction belt 13 and the drive roller 13A. Then, the circularly moving attraction belt 13 is supplied with an alternating voltage by the alternating-current power supply 16 via the charging roller 14. Thereby, the outer circumferential surface of the attraction belt 13 is formed with charge patterns that alternate with a pitch according to the frequency of the alternating-current power supply and the rotation speed of the attraction belt 13. Preferably, the pitch is set to approximately 5 mm to approximately 15 mm. As well as the alternating-current voltage, the power supply 16 may also provide a direct-current voltage alternated between high and low potentials. Further, the waveform of the voltage may be, for example, a rectangular or sine wave. In the present embodiment, the outer circumferential surface of the attraction belt 13 is supplied with a rectangular-wave voltage having an amplitude of approximately 4 kV (kilovolts).

An attraction operation will now be described. After the charge patterns are formed on the attraction belt 13 in the above-described manner, the support members 18 are rotated to lift the bottom plate 19. Almost simultaneously, the attractive separation unit 12 is rotated in the clockwise direction in the drawings to move the attraction belt 13 to the contact position thereof illustrated in FIG. 3A. In this process, the driven roller 13B is at first in contact with the lower end of the slot 15*b*. As the bottom plate 19 is lifted, the uppermost sheet S1 of the sheet stack 2 comes into contact with the driven roller 13B. Then, the bottom plate 19 is further lifted to push the driven roller 13B upward, and the driven roller 13B moves upward while being guided by the slot 15*b*. Then, upon contact of the driven roller 13B with the upper end of the slot 15*b*, the not-illustrated sheet detection device detects that the uppermost sheet S1 of the sheet stack 2 has arrived a predetermined position, and the lifting of the bottom plate 19 is stopped. In this state, a portion of the attraction belt 13 facing the upper surface of the sheet stack 2 is in contact with the uppermost sheet Si of the sheet stack 2. Further, the inter-axial distance between the driven roller 13B and the drive roller 13A corresponds to the relatively short inter-axial distance D1, and the tension of the attraction belt 13 is reduced. If the uppermost sheet S1 includes an undulating portion or the like, therefore, the attraction belt 13 deforms to fit the shape of the undulating portion of the uppermost sheet S1. Accordingly, a sufficient area of contact is obtained between the attraction belt 13 and the uppermost sheet S1. As the attraction belt 13 comes into contact with the uppermost sheet S1, Maxwell stress acts on the uppermost sheet S1, which is a dielectric material, due to the non-uniform electric field generated by the charge patterns formed on the outer circumferential surface of the attraction belt 13. As a result, the uppermost sheet S1 of the sheet stack 2 is attracted to the attraction belt 13. In this state, the attraction belt 13 deforms to fit the shape of the uppermost sheet S1, and is in contact with the uppermost sheet S1 with a sufficient area of contact. Therefore, the uppermost sheet S1 is favorably electrostatically attracted to the attraction belt 13.

A separating and conveying operation will now be described. After the attractive separation unit 12 stands by for a predetermined time in the state illustrated in FIG. 3A and the uppermost sheet S1 is attracted to the attraction belt 13, the side plate 15 of the attractive separation unit 12 is rotated in the counterclockwise direction in the drawings. Then, the drive roller 13A, which is the downstream tension roller in the sheet conveying direction, moves together with the side plate 15 in a direction separating from the sheet stack 2. Meanwhile, the driven roller 13B, which is the upstream tension roller in the sheet conveying direction, does not move from the upper surface of the sheet stack 2 due to the weight thereof, and moves away from the side plate 15 and toward the sheet stack 2. Thereby, the attraction belt 13 moves to swing around the center of rotation of the driven roller 13B, and a sheet attracted to the attraction belt 13 is bent at a portion of the attraction belt 13 wound around the driven roller 13B. As a result, a restoring force acts on the sheet attracted to the attraction belt 13. Accordingly, only the uppermost sheet S1 is attracted to the attraction belt 13, and the second sheet S2 is separated from the attraction belt 13 by the restoring force of the sheet. Further, in this state, the driven roller 13B moves in a direction separating from the drive roller 13A, and the tension of the attraction belt 13 is increased. As a result, the attraction belt 13 deformed to fit the shape of the uppermost sheet S1 is stretched into a linear shape. In this state, the uppermost sheet S1 is firmly electrostatically attracted to the attraction belt 13, and thus deforms into a linear shape in accordance with the shape of the attraction belt 13.

Figure 4:
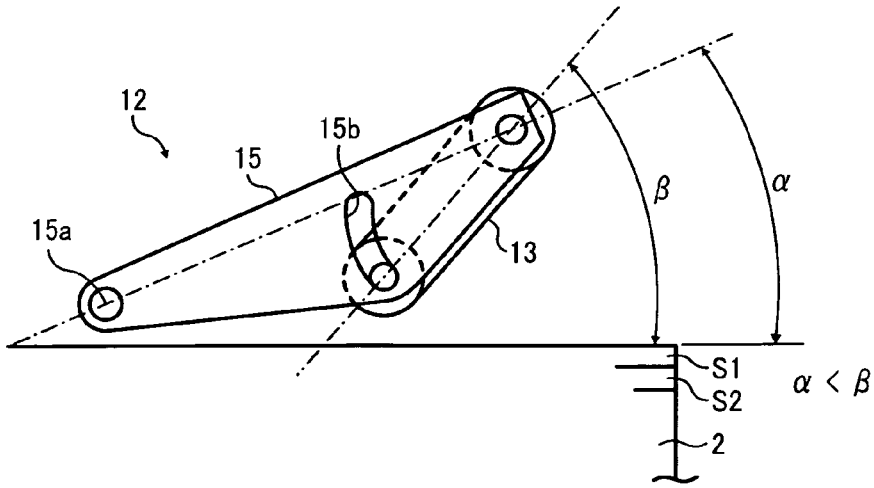
FIG. 4 is a diagram illustrating the angle between an attraction belt and a side plate at an adsorptive separation unit separation position.

In the present embodiment, the center of rotation of the side plate 15 of the attractive separation unit 12 is set to an upstream position in the sheet conveying direction, and the driven roller 13B is supported to be movable in the upward and downward directions with respect to the side plate 15. As illustrated in FIG. 4, therefore, it is possible to set the angle $\beta$ between the upper surface of the sheet stack 2 and the surface of the attraction belt 13 as viewed in the axial direction to be greater than the angle $\alpha$ between the upper surface of the sheet stack 2 and a line connecting the center of rotation of the side plate 15 and the center of rotation of the drive roller 13A, i.e., the angle of swing of the side plate 15. With the angle $\beta$ thus set to a relatively large value, the separation performance is improved.

If the side plate 15 is further rotated in the counterclockwise direction in the drawings, the driven roller 13B may hit against the lower end of the slot 15*b*. Then, if the side plate 15 is further rotated in the contact state of the driven roller 13B with the lower end of the slot 15*b*, the driven roller 13B may move together with the side plate 15 and separate from the upper surface of the sheet stack 2. Then, the rotation of the side plate 15 is stopped in the state illustrated in FIG. 3B. After the rotation of the side plate 15 is stopped, the electromagnetic clutch is turned on to drive the drive roller 13A to rotate. Thereby, the attraction belt 13 is circularly moved, and the uppermost sheet S1 attracted to the attraction belt 13 is conveyed toward the conveying roller pair 45. In this state, the inter-axial distance between the driven roller 13B and the drive roller 13A corresponds to the inter-axial distance D2, and the attraction belt 13 is stretched with relatively high tension. Therefore, the attraction belt 13 is favorably driven to rotate by the drive force of the drive roller 13A, with no slippage occurring between the attraction belt 13 and the drive roller 13A. Then, as the leading end of the uppermost sheet S1 electrostatically attracted to the attraction belt 13 reaches a portion of the attraction belt 13 wound around the drive roller 13A, the uppermost sheet S1 separates from the attraction belt 13 due to curvature separation, and moves toward the conveying roller pair 45 while being guided by the guide member 51.

Figure 5:
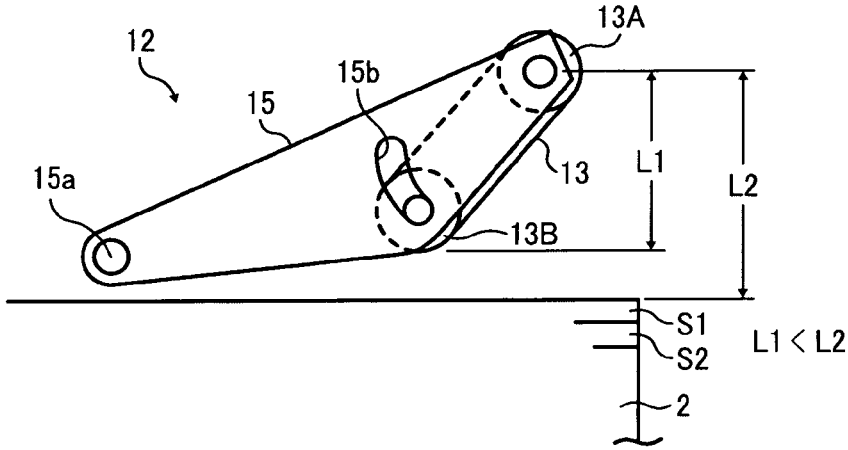
FIG. 5 is a diagram illustrating the separation of the attraction belt at the adsorptive separation unit separation position.

As illustrated in FIG. 5, in the sheet conveying operation by the attraction belt 13, a distance L1 is less than a distance L2. Herein, "L1" represents the vertical distance between the center of rotation of the drive roller 13A and the closest position of the attraction belt 13 to the sheet stack 2, and "L2" represents the vertical distance between the center of rotation of the drive roller 13A and the upper surface of the sheet stack 2. In the conveyance of the uppermost sheet S1 attracted to the attraction belt 13, therefore, the conveying force is prevented from being transmitted to the second sheet S2. Accordingly, the second sheet S2 does not move to the right side in the drawing.

The conveying roller pair 45 and the attraction belt 13 are set to have the same linear velocity. Therefore, if the conveying roller pair 45 is intermittently driven to adjust the timing, the attraction belt 13 is also controlled to be intermittently driven.

Further, in the present embodiment, the downstream tension roller in the sheet conveying direction is used as the drive roller. Therefore, the configuration of a drive transmission mechanism is simpler in the present embodiment than in a configuration which uses, as the drive roller, a downstream tension roller in the sheet conveying direction movable within a predetermined range with respect to the side plate 15. Accordingly, an increase in cost of the sheet conveying device 1 is prevented.

Further, the charging of the attraction belt 13 may be performed only over the length from the sheet separation position of the attraction belt 13 to the conveying roller pair 45, and the attraction belt 13 may be thereafter discharged by the charging roller 14. With this configuration, the uppermost sheet S1 conveyed to the conveying roller pair 45 will be thereafter conveyed solely by the conveying force of the conveying roller pair 45 with no influence from the attraction belt 13. Further, with the discharge of the attraction belt 13, the second sheet S2 having separated from the attraction belt 13 is prevented from being electrostatically attracted back to the attraction belt 13.

Herein, a description will be given of the principle of discharging the charge of the charged attraction belt 13 by applying an alternating voltage to the rotating attraction belt 13. If the outer circumferential surface of the attraction belt 13 is brought into contact with a charging electrode, such as a conductive roller, and supplied with a direct-current voltage by a direct-current power supply, the attraction belt 13 is not charged by the applied direct-current voltage if the direct-current voltage does not reach a predetermined voltage. The predetermined voltage is referred to as the charge start voltage. The charge start voltage value $V_0$ varies depending on, for example, the thickness and the volume resistivity of the attraction belt 13. Further, it has been confirmed that, if the charging roller 14 is supplied with an alternating voltage having the above-described charge start voltage value $V_0$ as the peak value thereof, the surface potential of the charged attraction belt 13 is discharged to substantially 0V. This indicates that the applied voltage having the charge start voltage value $V_0$ as the peak value thereof is not capable of charging the attraction belt 13, which is a dielectric material, but is capable of discharging the attraction belt 13 with force for moving the space charge in the attraction belt 13. Further, the applied voltage used here alternates, and thus has the discharging effect whether the attraction belt 13 is positively charged or negatively charged. If the applied voltage does not reach the charge start voltage, however, insufficient discharging is caused. Meanwhile, if the applied voltage exceeds the charge start voltage, charging takes place with an applied frequency of approximately 120 Hz (hertz) and a period (i.e., wavelength=velocity/frequency) of approximately 1 mm, and the attraction belt 13 fails to be discharged to approximately 0V. It is therefore desired to control the peak value of the alternating voltage of the alternating-current power supply 16 to be equal to the charge start voltage of the attraction belt 13.

Figure 6A:
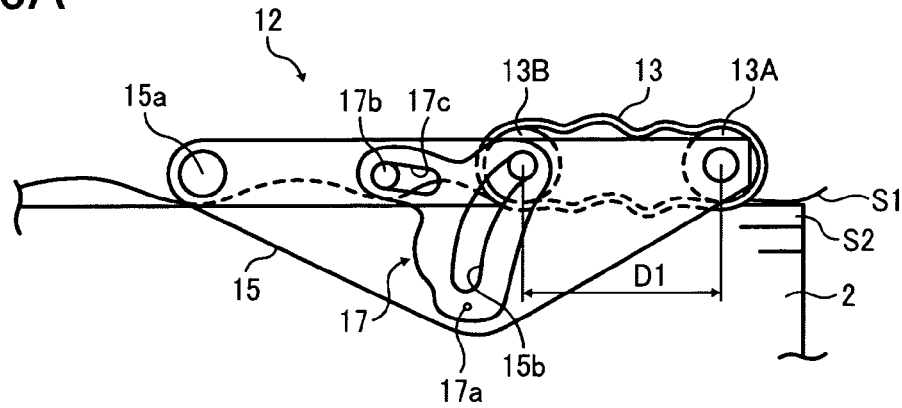
FIGS. 6A and 6B are configuration diagrams of relevant components of a first modified example of the sheet conveying device.
Figure 6B:
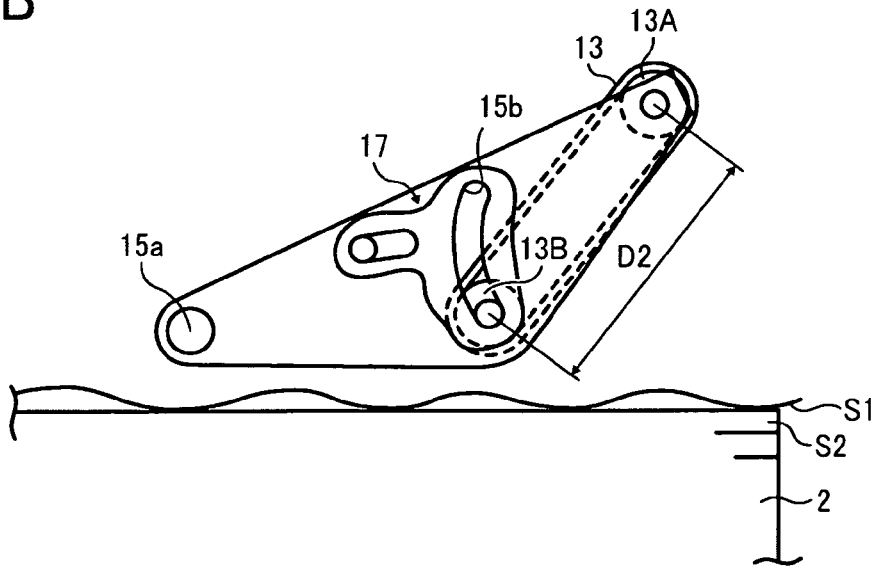

Subsequently, variations of the present embodiment will be described. FIGS. 6A and 6B are configuration diagrams of relevant components of a first modified example of the sheet conveying device 1. As illustrated in FIGS. 6A and 6B, in the first modified example, a slotted member 17 formed with the slot 15*b* is rotatably attached to the side plate 15 that serves as a swing member.

As illustrated in the drawings, the slotted member 17 includes an engaging hole formed in a lower portion thereof to engage with an engaging pin 17*a* projecting from the side plate 15. Further, a left portion of the slotted member 17 in the drawings includes a positioning hole 17*c* having an elongated shape. A screw 17*b* is inserted in the positioning hole 17*c* and screwed into a screw hole formed in the side plate 15. Thereby, the slotted member 17 is attached to the side plate 15.

The slotted member 17 is rotated relative to the side plate 15 around the engaging pin 17*a* as a fulcrum. Thereby, the inter-axial distance D1 between the drive roller 13A and the driven roller 13B at the contact position of the attraction belt 13 is adjusted. For example, under a condition in which undulation easily occurs in the sheets stacked on a sheet-feeding tray, such as a relatively high humidity environment of use of the sheet conveying device 1, the slotted member 17 is rotated to adjust the position thereof with respect to the side plate 15 such that the inter-axial distance D1 is less than the inter-axial distance D2 at the separation position illustrated in FIG. 6B, and that the tension of the attraction belt 13 at the contact position is reduced. Meanwhile, under a condition in which undulation hardly occurs in the sheets stacked on the sheet-feeding tray, such as a circumstance in which the sheets are relatively thick, the slotted member 17 is rotated to adjust the position thereof with respect to the side plate 15 such that the inter-axial distance D1 at the contact position is equal to the inter-axial distance D2 at the separation position.

According to the present embodiment, the screw 17*b* is loosened to manually rotate the slotted member 17 and adjust the inter-axial distance D1 at the contact position. Alternatively, the slotted member 17 may be rotated by a drive device, such as an actuator, to automatically adjust the inter-axial distance D1 at the contact position. For example, the sheet conveying device 1 may be configured to include a humidity sensor provided to the body thereof, and to rotate the slotted member 17 on the basis of the humidity sensor to adjust the inter-axial distance D1 at the contact position, or may be configured to rotate the slotted member 17 on the basis of the sheet thickness to adjust the inter-axial distance D1 at the contact position.

As described above, the sheet conveying device 1 according to the present embodiment includes the attraction belt 13 arranged to face the upper surface of the stacked sheet stack 2, the charging roller 14 that serves as a charging device that charges a surface of the attraction belt 13, and the contacting and separating device which causes the attraction belt 13 to come in contact with and separate from the sheet stack 2, and which is configured to include, for example, the side-plate 15, the rotary shaft 15*a*, and the drive device. Further, different tensions are set for the attraction belt 13 at the contact position in contact with the uppermost sheet S1 of the sheet stack 2 and the attraction belt 13 at the separation position separate from the sheet stack 2. Specifically, the tension of the attraction belt 13 at the contact position is set to be lower than the tension of the attraction belt 13 at the separation position. With the tension of the attraction belt 13 at the contact position thus set to be lower than the tension of the attraction belt 13 at the separation position, the attraction belt 13 at the contact position is deformed to fit the shape of the uppermost sheet S1. Thereby, a sufficient area of contact is obtained between the uppermost sheet S1 and the attraction belt 13, and the uppermost sheet S1 is favorably attracted to the attraction belt 13. Further, the attraction belt 13 at the separation position is stretched with relatively high tension. Therefore, the attraction belt 13 is favorably driven to rotate with no slippage occurring between the attraction belt 13 and the drive roller 13A. Accordingly, the uppermost sheet S1 attracted to the attraction belt 13 is favorably conveyed toward the conveying roller pair 45.

Further, the attraction belt 13 is stretched with tension by two rollers, and the contacting and separating device includes the side plate 15 that serves as a swing member that rotatably supports the two rollers and is supported to be swingable around a fulcrum set to a position upstream in the sheet conveying direction of the driven roller 13B, which is the upstream one of the two rollers in the sheet conveying direction. Further, the side plate 15 supports the driven roller 13B to be movable in the upward and downward directions within a predetermined range with respect to the upper surface of the sheet stack 2. With the above-described configuration, when the attraction belt 13 in contact with the uppermost sheet Si of the sheet stack 2 is swung in the direction separating from the upper surface of the sheet stack 2, the driven roller 13B, which is supported by the side plate 15 to be movable in the upward and downward directions within the predetermined range with respect to the upper surface of the sheet stack 2, relatively moves away from the side plate 15 toward the upper surface of the sheet stack 2. That is, the drive roller 13A moves together with the side plate 15 in the direction separating from the upper surface of the sheet stack 2, while the driven roller 13B is in contact with the upper surface of the sheet stack 2 via the attraction belt 13. Thereby, the attraction belt 13 moves to swing around the axis of rotation of the driven roller 13B, and a sheet attracted to the attraction belt 13 is bent at a portion of the attraction belt 13 wound around the driven roller 13B as a fulcrum. Thereby, restoring force acts on the sheet attracted to the attraction belt 13. Accordingly, only the uppermost sheet S1 is attracted to the attraction belt 13, and the second sheet S2 is separated from the attraction belt 13 by the restoring force of the sheet. Further, if the side plate 15 is further swung in the direction of separating the attraction belt 13 from the upper surface of the sheet stack 2 to move the driven roller 13B relative to the side plate 15 to a predetermined range, the driven roller 13B moves together with the side plate 15 in the direction separating from the upper surface of the sheet stack 2. Thereby, a portion of the attraction belt 13 wound around the driven roller 13B separates from the upper surface of the sheet stack 2. Accordingly, the attraction belt 13 is completely separated from the upper surface of the sheet stack 2. Therefore, even if the attraction belt 13 in this state is rotated and the rear end of the uppermost sheet S1 attracted to and conveyed by the attraction belt 13 passes under the portion of the attraction belt 13 wound around the driven roller 13B, the second sheet S2 does not receive the conveying force of the attraction belt 13.

Further, the driven roller 13B is rotatably supported by the slot 15*b* provided in the side plate 15 of the attractive separation unit 12. With a relatively simple configuration, therefore, the driven roller 13B is supported to be movable in the upward and downward directions within a predetermined range with respect to the upper surface of the sheet stack 2. Further, the slot 15*b* is configured such that the inter-axial distance between the drive roller 13A and the driven roller 13B at the contact position is less than the inter-axial distance between the drive roller 13A and the driven roller 13B at the separation position. Accordingly, the tension of the attraction belt 13 at the contact position is set to be lower than the tension of the attraction belt 13 at the separation position.

Further, as illustrated in FIGS. 6A and 6B, the sheet conveying device 1 includes the slotted member 17 formed with the slot 15*b* and rotatably attached to the side plate 15. With the rotation of the slotted member 17 relative to the side plate 15, therefore, the inter-axial distance between the drive roller 13A and the driven roller 13B is adjusted. Accordingly, the amount of variation in tension between the attraction belt 13 at the contact position and the attraction belt 13 at the separation position is adjusted simply by the rotation of the slotted member 17.

The above-described embodiments are illustrative and do not limit the present invention. Thus, numerous additional modifications and variations are possible in light of the above teachings. For example, elements having at least one of features of different illustrative and exemplary embodiments herein may be combined with each other at least one of substituted for each other within the scope of this disclosure and appended claims. Further, features of components of the embodiments, such as the number, the position and the shape, are not limited the embodiments and thus may be set as appropriate. It is therefore to be understood that, within the scope of the appended claims, the disclosure of this patent specification may be practiced otherwise than as specifically described herein.

The invention claimed is:

1. A sheet conveying device, comprising:

an attraction belt arranged to face the upper surface of a sheet stack;

multiple rollers around which the attraction belt is wound, to keep the attraction belt taut, wherein the multiple rollers include two rollers including an upstream roller and a downstream roller in the sheet conveying direction, and a charging device to charge a surface of the attraction belt, located in proximity to the attraction belt; and a contacting and separating device to contact the attraction belt with and then separate from the sheet stack, with different tensions on the attraction belt at a contact position in contact with the uppermost sheet of the sheet stack and at a separation position separate from the sheet stack, wherein tension of the attraction belt at the contact position in contact with the uppermost sheet of the sheet stack is relatively lower than tension of the attraction belt at the separation position separate from the sheet stack, wherein the contacting and separating device includes a side plate swingably supported around a fulcrum positioned upstream of the upstream roller in the sheet conveying direction, the side plate rotatably supporting the two rollers and supporting the upstream roller to be movable in upward and downward directions within a range with respect to the upper surface of the sheet stack, and wherein the upstream roller is configured to move by its own weight, away from the downstream roller, thereby relatively increasing the tension of the attraction belt.

2. The sheet conveying device according to claim 1, wherein the side plate includes a slot configured to rotatably support the upstream roller, shaped so that an inter-axial distance between the two rollers at the contact position to be less than the inter-axial distance between the two rollers at the separation position.

3. The sheet conveying device according to claim 2, furthered comprising a slotted member rotatably attached to the side plate, wherein the slot is provided in the slotted member.

4. An image forming apparatus, comprising:

an image forming device to form an image on a sheet; and the sheet conveying device according to claim 1 to separate an uppermost sheet from a sheet stack set to the image forming apparatus and convey the uppermost sheet to the image forming device.

* * * * *